US008224229B2

(12) United States Patent
Okamoto

(10) Patent No.: US 8,224,229 B2
(45) Date of Patent: Jul. 17, 2012

(54) IMAGE FORMING APPARATUS

(75) Inventor: Tsugio Okamoto, Kani (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 439 days.

(21) Appl. No.: 12/608,289

(22) Filed: Oct. 29, 2009

(65) Prior Publication Data

US 2010/0104311 A1 Apr. 29, 2010

(30) Foreign Application Priority Data

Oct. 29, 2008 (JP) ..... 2008-278034

(51) Int. Cl.
*B65H 1/24* (2006.01)
*B65H 1/14* (2006.01)

(52) U.S. Cl. ..... 399/393; 399/391; 400/624

(58) Field of Classification Search ..... 400/186, 400/624; 399/391, 393; 271/147, 126, 127; 475/323, 324; *B65H 1/24, 1/14*
See application file for complete search history.

(56) References Cited

U.S. PATENT DOCUMENTS 7,461,840 B2 * 12/2008 Hattori ..... 271/110
7,984,902 B2 * 7/2011 Kuroda ..... 271/156
2005/0286947 A1 * 12/2005 Kitamura ..... 399/393

FOREIGN PATENT DOCUMENTS

JP 2006-176321 7/2006
JP 2007-269462 10/2007

* cited by examiner

*Primary Examiner* — Judy Nguyen
*Assistant Examiner* — Jennifer Simmons
(74) *Attorney, Agent, or Firm* — Banner & Witcoff, Ltd.

(57) ABSTRACT

An image forming apparatus is swung with a stopper which is swingable simultaneously with a switching member, and which allows rotation of an output gear by being disengaged from the output gear with a swinging movement of the switching member to an ON side, and which stops the rotation of the output gear by being engaged with the output gear with a swinging movement of the switching member to an OFF side. When the switching member is swung to the OFF side, the stopper is engaged with the output gear at the same time as the switching member is disengaged from the triggering member or before the switching member is disengaged from the triggering member. Accordingly, a descent of a pressing plate at the time of stopping the pressing plate is prevented without using a one-way clutch.

9 Claims, 10 Drawing Sheets

IMAGE FORMING APPARATUS

CROSS REFERENCE TO RELATED APPLICATION

The present application claims priority from Japanese Patent Application No. 2008-278034, filed on Oct. 29, 2008, the disclosure of which is incorporated herein by reference in its entirety.

BACKGROUND OF THE INVENTION

1. Field of the Invention

The present invention relates to an image forming apparatus, and in particular, to an improvement of a feeding mechanism which feeds sheet material one-by-one.

2. Description of the Related Art

In an electrophotographic image forming apparatus, a paper feeding roller (a pick-up roller) which makes a contact with an uppermost sheet material among the stacked sheet material, is provided for feeding the sheet material one-by-one. For feeding the sheet material one-by-one, it is important that the paper feeding roller is pressed against the sheet material with a predetermined thrust. Incidentally, since the sheet material is consumed one-by-one as the image formation goes on, a position of the uppermost sheet material goes on changing gradually. Therefore, a moving mechanism which moves the sheet material and the paper feeding roller depending on the position variation of the sheet material with the consumption of the sheet material is necessary for keeping a constant pressure of the paper feeding roller against the sheet material.

An image forming apparatus described in Japanese Patent Application Laid-open No. 2007-269462, includes a driving-force transmitting mechanism which transmits a driving force for lifting up a pressing plate (loading plate) in a paper supply tray. Moreover, the driving-force transmitting mechanism has a one-way clutch which regulates a downward displacement of the pressing plate. In other words, the one-way clutch is used such that even when the driving force is not applied to the pressing plate, the pressing plate does not move downward by a weight of recording sheets mounted on the pressing plate.

SUMMARY OF THE INVENTION

However, in a case of adding a commercially available one-way clutch as a component, there is a problem that the lifting plate is lowered according to a play (backlash) of the one-way clutch. For instance, in an image forming apparatus described in Japanese Patent Application Laid-open No. 2007-269462, the one-way clutch is installed on a gear 227 which is arranged in the body at the extreme downstream side. Therefore, the backlash of the one-way clutch has a substantial effect on an amount of downward displacement of the pressing plate, and after the driving force which lifts the pressing plate is cut off, the pressing plate was lowered by about 0.8 mm maximum.

The present invention has been made in view of the above-mentioned circumstances, and an object of the present invention is to prevent a descent of the pressing plate without using the so-called one-way clutch.

According to an aspect of the present invention, there is provided an image forming apparatus which forms an image on sheet materials, including a body of the image forming apparatus;

a tray which is detachably attached to the body, and which accommodates the sheet materials which are stacked;

a pickup roller which is arranged to be movable upward and downward, and which makes a contact from an upper side with an uppermost sheet material among the stacked sheet materials accommodated in the tray;

a pressing plate which is arranged below the sheet materials in the tray, and which presses to lift the sheet materials up when the sheet materials are fed;

a planetary gear mechanism including a sun gear which has outer teeth formed on an outer circumferential surface thereof, a ring gear which has inner teeth formed on an inner circumferential surface thereof and which is arranged surrounding the sun gear, planetary gears which are arranged between the sun gear and the ring gear and which are engaged with both the sun gear and the ring gear, and a carrier which supports the planetary gears, one of the sun gear, the carrier, and the ring gear being an input gear section, and another one of the sun gear, the carrier, and the ring gear being an output gear section, and the remaining one of the sun gear, the carrier, and the ring gear being a triggering member for power transmission;

a drive source which is engaged with the input gear section and imparts a driving power to the input gear section;

a pressing plate-lifting mechanism which is engaged with the output gear section, and which converts rotation of the output gear section to a driving power for lifting the pressing plate upward;

a switching member which is swingably arranged in two directions of an ON side and an OFF side, and which is engaged with the triggering member when swung to the ON side to transmit the rotation of the input gear section to the output gear section, and which is disengaged from the triggering member when swung to the OFF side to cut off the rotation of the input gear section and the output gear section;

a pressing plate-control mechanism which is movable according to the upward and downward movement of the pickup roller, and which controls the switching member to swing to the OFF side when the pressing plate pushes the pickup roller upward to an uppermost position via the sheet materials, and which controls the switching member to swing to the ON side when the sheet materials are consumed and the pickup roller is lowered to a lowermost position;

a stopper which is swingable in synchronization with the switching member, and which is disengaged from the output gear section when the switching member is swung to the ON side to allow the rotation of the output gear section, and which is engaged with the output gear section when the switching member is swung to the OFF side to stop the rotation of the output gear section; and a spring member which biases the stopper toward the switching member to bring the stopper in contact with the switching member and to make the switching member and the stopper swing in synchronization, and which is deformed when the switching member is swung to the OFF side to make the switching member be swingable separately from the stopper;

wherein when the switching member has swung to the OFF side, the stopper is engaged with the output gear section at a same time as the switching member is disengaged from the triggering member or before the switching member is disengaged from the triggering member.

According to such structure, the driving force of the drive source is transmitted to the input gear section, the output gear section of the planetary gear mechanism and the pressing plate lifting mechanism to lift the pressing plate. Moreover, the driving power is transmitted (turn ON), when the switching member is swung to the ON side to be engaged with the triggering member, and the driving power is ceased to be transmitted (turn OFF), when the switching member is swung to the OFF side to be disengaged from the triggering member. When the stopper is biased to the switching member by the spring member, the stopper is swung simultaneously as the swinging of the switching member. Therefore, when the switching member is swung to the OFF side from a state of being positioned at the ON side, the stopper is swung simultaneously, and the stopper is engaged with the output gear at the same time as the switching member is disengaged from the triggering member, or before the switching member is disengaged from the triggering member. Accordingly, the stopper stops the rotation of the output gear. Moreover, when the spring member is deformed after the stopper has engaged with the output gear, the switching member is swung separately from the stopper, and the switching member is sufficiently disengaged from the triggering member. In this manner, when the stopper is engaged with the output gear, it is possible to prevent the descent of the pressing plate.

Moreover, since the stopper is engaged with the output gear at the same time as the switching member is disengaged from the triggering member or before the switching member is disengaged from the triggering member, the descent of the pressing plate due to the backlash (play) in the engagement of the stopper and the output gear is suppressed to minimum.

According to the image forming apparatus of the present invention, the descent of the pressing plate is prevented when the stopper is engaged with the output gear at the same time as the switching member is disengaged from the triggering member, or before the switching member is disengaged from the triggering member. Therefore, it is possible to prevent the descent of the pressing plate without using a so-called one-way clutch.

DETAILED DESCRIPTION OF THE PREFERRED EMBODIMENTS

<Overall Structure of Laser Printer>

Figure 1:
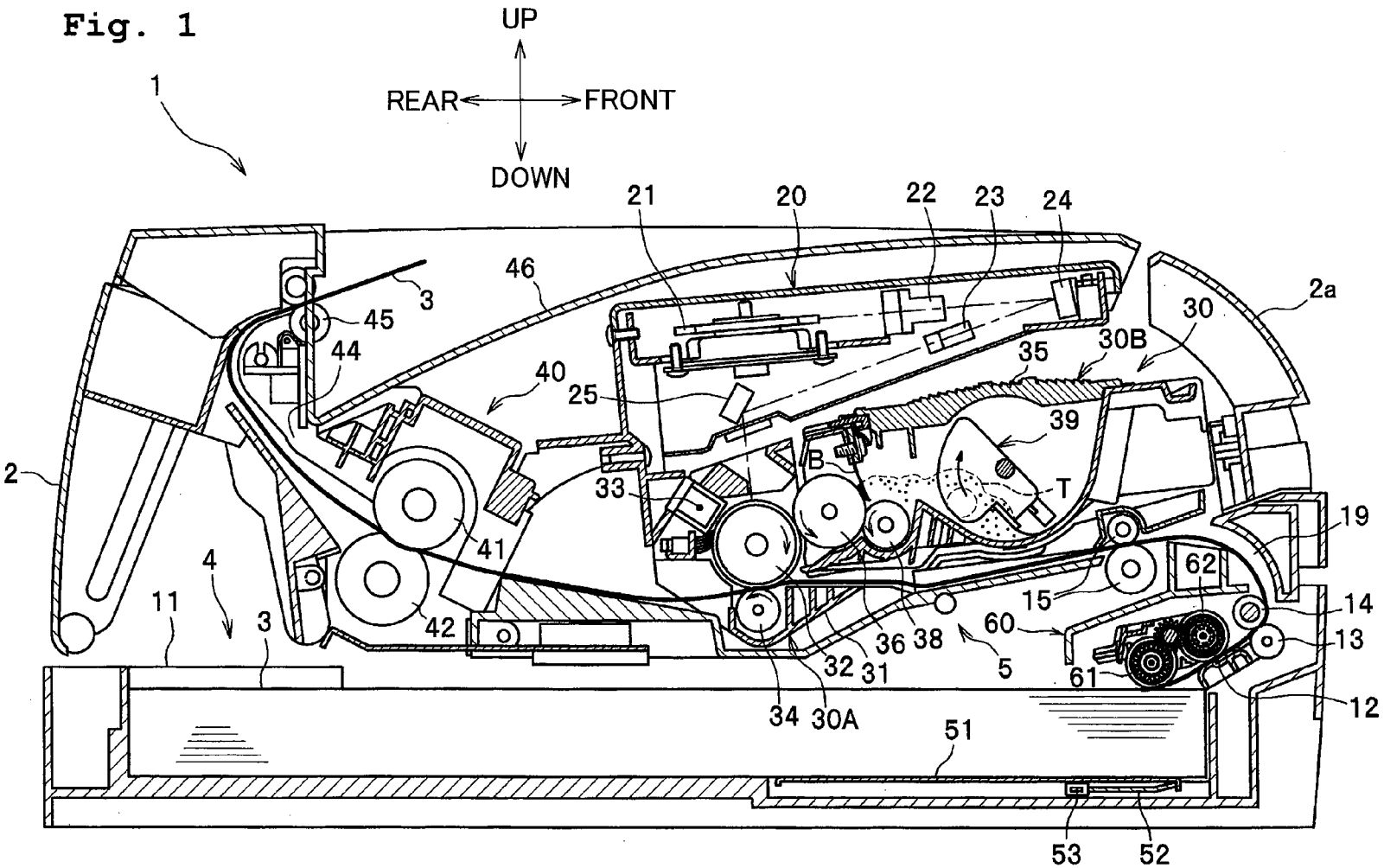
FIG. 1 is a side cross-sectional view of main components of a laser printer according to an embodiment of the present invention.

Next, an embodiment of the present invention will be described below with reference to the diagrams. In the following description, a right side in FIG. 1 is defined as a front side, and a left side is defined as a rear side. As shown in FIG. 1, a laser printer 1 as an example of an image forming apparatus, includes a feeder section 4 for feeding a paper 3 as an example of a sheet material which is supplied to a casing 2, and an image forming section 5 for forming an image on the paper 3. A front cover 2*a* which is openable is provided at a front side of the casing 2. When the front cover 2*a* is opened, it is possible to mount and dismount a process cartridge 30 which will be described later via the opening.

<Structure of Feeder Section>

The feeder section 4 includes a paper feeding tray 11 as an example of a feeding tray, which is detachably mounted on a bottom portion of the casing 2; a pressing plate (pressurizing plate) 51 which is installed under the paper 3 at a lower portion of the paper feeding tray 11, and which is swingably provided such that the frontward portion thereof can be lifted up for lifting up the paper 3 at the time of paper feeding; and a lifting plate 52 which lifts up the pressing plate 51. A rear end 53 of the lifting plate 52 is rotatably supported by the paper feeding tray 11. As it will be described later, when a rotational driving force due to the driving force transmitted from the body of the apparatus (apparatus body) is imparted to the lifting plate 52, the lifting plate 52 turns around the rear end 53 to lift up the pressing plate 51. In this specification, the 'body (apparatus body)' means a portion excluding the paper feeding tray 11 and the components which are installed on the paper feeding tray 11, from the laser printer 1.

Moreover, a pickup roller 61 which makes a contact with the paper 3 loaded in the paper feeding tray 11 from an upper side is arranged above the front side of the paper feeding tray 11, and a separating roller 62 is arranged at a front side of the pickup roller 61. A resist roller 15 is arranged at an upper side of the pickup roller 61. The separating roller 62 is arranged to face a separating pad 12 which is installed on the paper feeding tray 11. A paper-dust removing roller 13 and a facing roller 14 are arranged to face with each other, at a further frontward side of the separating roller 62. After the paper 3 has passed between the paper-dust removing roller 13 and the facing roller 14, the paper 3 is turned around rearward along a transporting path 19.

In the feeder section 4, when the paper 3 in the paper feeding tray 11 is lifted up by the lifting plate 52 and the pressing plate 51, the uppermost paper 3 is sent toward the separating roller 62 by the pickup roller 61. At this time, only the uppermost paper 3 is separated by a friction between the separating roller 62 and the separating pad 12, and is sent toward the facing roller 14. The paper 3 is transported to the image forming section 5 one-by-one.

<Structure of Image Forming Section>

The image forming section 5 includes a scanner section 20, a process cartridge 30, and a fixing section 40.

<Structure of Scanner Section>

The scanner section 20 includes a laser emitting section which is not shown in the diagram but provided at an upper portion in the casing 2, a polygon mirror 21 which is driven to rotate, lenses 22 and 23, and reflecting mirrors 24 and 25. As shown by a dot-dashed line in FIG. 1, a laser beam which is emitted from the laser emitting section passes through or is reflected by the polygon mirror 21, the lens 22, the reflecting mirror 24, the lens 23, and the reflecting mirror 25, in this order, and the laser beam is irradiated by a high-speed scanning on a surface of a photoconductive drum 32 of the process cartridge 30, based on the image data.

<Structure of Process Cartridge>

The process cartridge 30 is installed at a lower side of the scanner section 20, and is detachably mounted on the casing 2. This process cartridge 30 has a photoconductive-body cartridge 30A which supports the photoconductive drum 32, and a developer cartridge 30B which is detachably mounted on the photoconductive-body cartridge 30A. The photoconductive drum 32, a scortoron charger 33, and a transfer roller 34 are provided inside a photoconductive-body case 31 which forms an outer frame of the photoconductive body cartridge 30A.

The developer cartridge 30B is detachably attached to the photoconductive-body cartridge 30A. The developer cartridge 30B includes a developer case 35 which accommodates a toner T as a developer, a developing roller 36, a supply roller 38, and an agitator 39. The developing roller 36, the supply roller 38, and the agitator 39 are rotatably supported in the developer case 35. The toner T in the developer case 35 is supplied to the developing roller 36 when the supply roller 38 rotates in an arrow direction (counterclockwise direction). At this time, the toner T is charged positively due to a frictional charging between the supply roller 38 and the developing roller 36. When the developing roller 36 rotates in the arrow direction (the counterclockwise direction), the toner T supplied onto the developing roller 36 enters between a blade B for regulating a thickness of the layer and the developing roller 36, and is held on the developing roller 36 as a thin layer of a constant thickness.

The photoconductive drum 32 is supported by the photoconductive-body case 31 in which the developer cartridge 30B is installed, such that the photoconductive drum 32 is rotatable in the arrow direction (clockwise direction). A drum body of the photoconductive drum 32 is grounded, and an outer surface of the photoconductive drum 32 is formed by a photoconductive layer having a positive charging characteristics.

The scortoron charger 33 is arranged above the photoconductive drum 32, to face the photoconductive drum 32 with a predetermined distance (gap), such that the scortoron charger 33 does not making a contact with the photoconductive drum 32. The scortoron charger 33 is a charger for positive charging which generates a corona discharge from a wire such as a tungsten wire, and charges the surface of the photoconductive drum 32 positively and uniformly.

The transfer roller 34 is arranged to face the photoconductive drum 32 at a lower side of the photoconductive drum 32, such that the transfer roller 34 makes a contact with the photoconductive drum 32. The transfer roller 34 is rotatably supported by the photoconductive-body case 31 to rotate in the arrow direction (in the counterclockwise direction). The transfer roller 34 includes a roller shaft of a metallic material and an electroconductive rubber material covering the roller shaft. A transfer bias is applied to the transfer roller 34 at the time of transfer, by a constant current control.

Moreover, after the surface of the photoconductive drum 32 is positively charged uniformly by the scortoron charger 33, the surface of the photoconductive drum 32 is exposed by a high-speed scanning of laser beam from the scanner section 20. Accordingly, an electric potential of an exposed portion of the surface of the photoconductive drum 32 is lowered, and an electrostatic latent image based on image data is formed on the photoconductive drum 32. Here, the 'electrostatic latent image' means an image which is formed by the exposed portion, of the surface of the uniformly charged photoconductive drum, of which the electric potential is lowered by the exposure of the laser beam to a positive polarity. Next, when the toner T which is carried on the developing roller 36 makes a contact with the photoconductive drum 32 due to the rotation of the developing roller 36, the toner T is supplied to the electrostatic latent image formed on the surface of the photoconductive drum 32. Moreover, when the toner T is carried selectively on the surface of the photoconductive drum 32, the electrostatic latent image is transformed into a visible image, and accordingly, a toner image is formed by an inverse developing.

Thereafter, the photoconductive drum 32 and the transfer roller 34 are driven to rotate such that the photoconductive drum 32 and the transfer roller 34 pinch the paper 3 therebetween to transport the paper 3. When the paper 3 is transported between the photoconductive drum 32 and the transfer roller 34, the toner image which is carried on the surface of the photoconductive drum 32 is transferred on to the paper 3.

<Structure of Fixing Section>

The fixing section 40 is arranged at a downstream side of the process cartridge 30, and includes a heating roller 41, and a pressing roller 42 which is arranged facing the heating roller 41 to pinch the paper 3 between the heating roller 41 and the pressing roller 42. Moreover, in the fixing section 40, the toner T transferred onto the paper 3 is subjected to thermal fixing while the paper 3 passes between the heating roller 41 and the pressurizing roller 42. Thereafter, the paper 3 is transported to a paper discharge path 44. The paper 3 sent to the paper discharge path 44 is discharged to a paper discharge tray 46 by a paper discharge roller 45.

<Detailed Structure of Feeder Section>

Figures 2A, 2B:
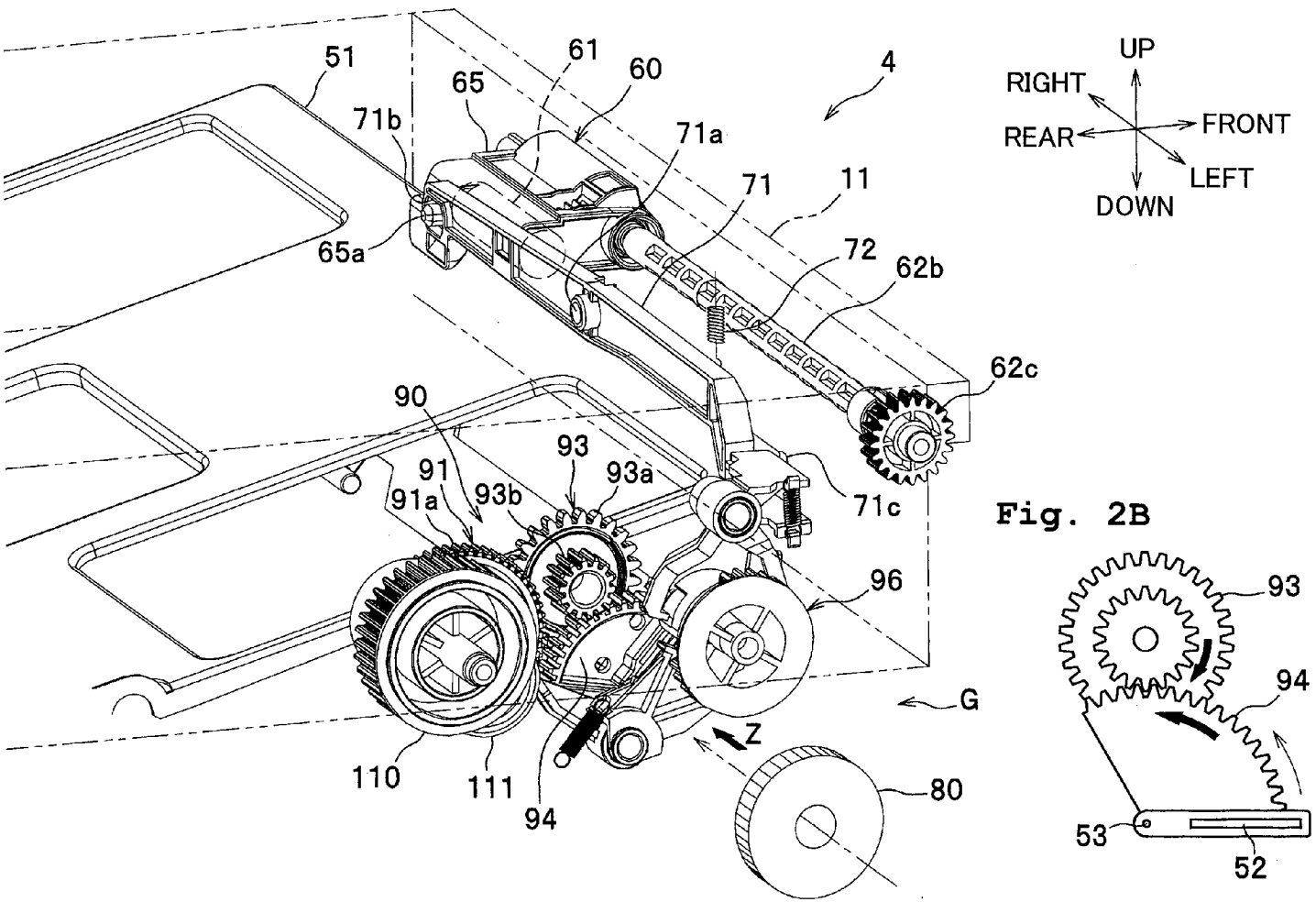
FIG. 2A is a perspective view when a pickup roller and a gear mechanism portion which drives the pickup roller are viewed from a rear-left side.
FIG. 2B is a view from a direction of an arrow in Z direction of FIG. 2A.
Figures 3A, 3B:
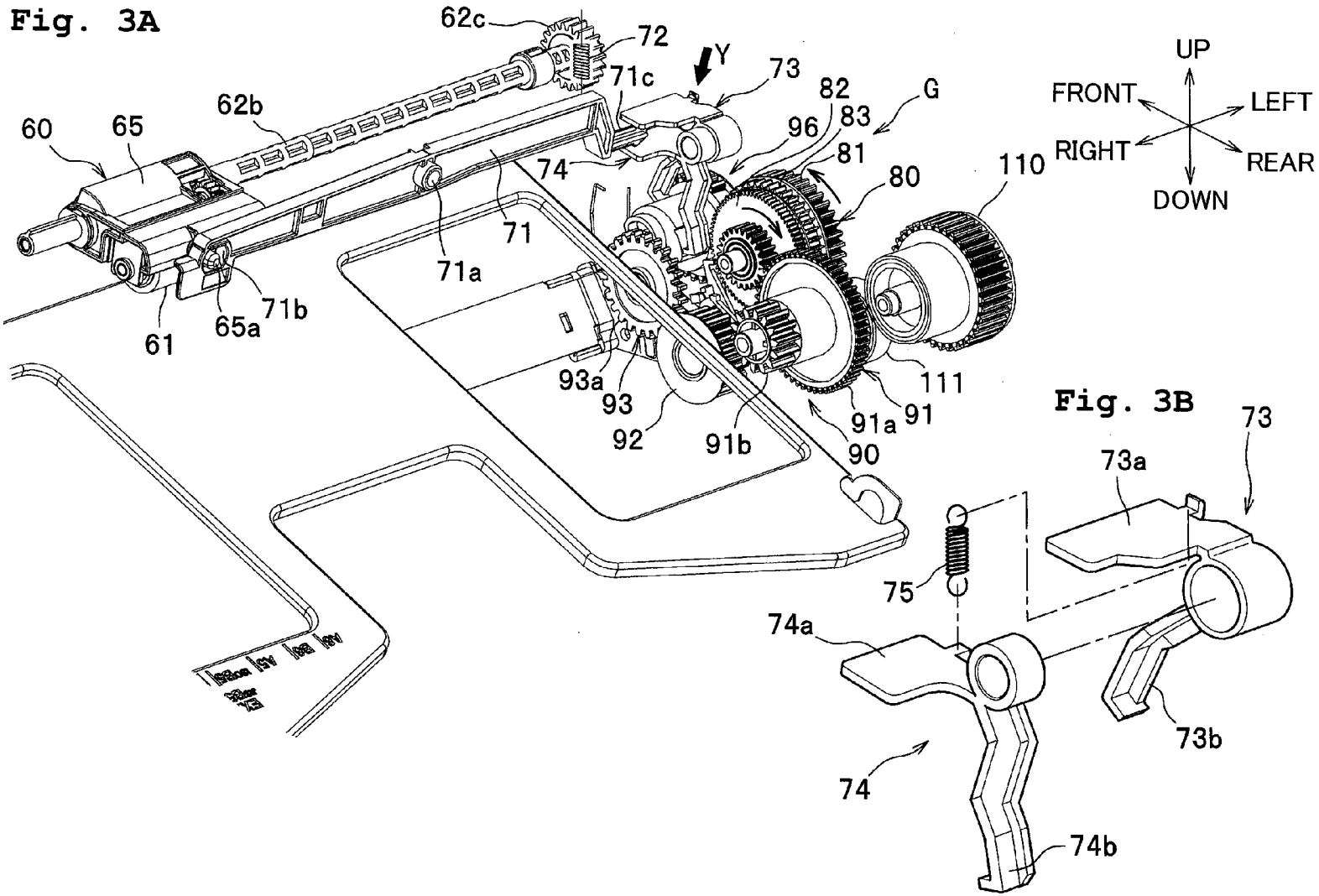
FIG. 3A is a perspective view when the pickup roller and the gear mechanism portion are viewed from rear-right side.
FIG. 3B is an exploded enlarged view of a Y-portion in FIG. 3A.

Next, a detailed structure of the feeder section 4 will be described below. In FIGS. 2A and 3A, the paper 3 is omitted.

As shown in FIGS. 2A and 2B, in addition to the structure described above, the feeder section 4 includes a pickup roller assembly 60, a separating roller shaft 62*b* which is coupled with the separating roller 62, and a lifting arm 71 which swingably supports the pickup roller assembly 60 as it will be described later. The pickup roller assembly 60 includes a holder 65, a pickup roller 61, a separating roller 62, and gears which are not shown in the diagram and which transmit the driving force applied to the separating roller 62 to the pickup roller 61. The pickup roller 61 is rotatably supported by the holder 65, and a driving force from a transmitting gear mechanism portion G which will be described later is transmitted to the pickup roller 61 via the separating roller shaft 62*b*. Moreover, a vertical movement of the pickup roller 61 is transmitted to the transmitting gear mechanism portion G via the lifting arm 71, and the pickup roller 61 is biased downward by the lifting arm 71.

The pickup roller assembly 60 is swingable around the separating roller shaft 62*b*, and is separated from an uppermost surface of the stacked papers 3 when the paper feeding tray 11 is mounted on the apparatus body. When the paper 3 is lifted up by the pressing plate 51 by using a structure of power transmission which will be described later, the pickup roller 61 is pushed up by the paper 3. As it will be described later, when the pickup roller 61 is lifted up to a predetermined height, an ascending movement of the pressing plate 51 stops. Moreover, when more than a dozen sheets of the papers 3 are used and a position of the pickup roller 61 is lowered, the pressing plate 51 ascends up once again, and lifts the papers 3 till the pickup roller 61 reaches a predetermined height. In other words, the pickup roller 61 functions as a sensor for a height-position of the uppermost surface of the papers 3. In the image forming apparatus of the embodiment, such operation (movement) is realized by a mechanical structure. Such structure has hitherto been known, and is also described in U.S. Pat. No. 7,461,840 B2 corresponding to Japanese Patent Application Laid-open No. 2006-176321.

<Power Transmission from Separating Roller Driving Gear to Pickup Roller>

As it has been described above, the separating roller shaft 62*b* is coupled with the pickup roller 61 via a number of gears. A separating roller drive gear 62*c* is provided at a left end of the separating roller shaft 62*b*. Power is transmitted to the separating roller drive gear 62*c* from a driving force input gear 110 as an example of a drive source via a plurality of idle gears which are not shown in the diagram. As shown in a hitherto known structure which has been described in Japanese Patent Application Laid-open No. 2006-176321, the separating roller drive gear 62*c* is driven to rotate only at the time of paper feeding. The separating roller shaft 62*b* and the pickup roller assembly 60 are installed on the apparatus body.

The lifting arm (elongated member) 71 is swingably supported by the apparatus body at a supporting point located at a substantial center of the lifting arm 71. An engaging hole 71*b* is formed at a right end of the lifting arm 71, and is engaged with a protrusion 65*a* of the holder 65. Moreover, a left end 71*c* of the lifting arm 71 is engaged with the transmitting gear mechanism portion G. A lower end of a coil spring 72 is engaged with the lifting arm 71 at a slightly inner side (toward the supporting point 71*a*) of the left end 71*c* of the lifting arm 71. An upper end of the coil spring 72 is engaged with the apparatus body which is not shown in the diagram, and the coil spring 72 pulls up the left end 71*c* of the lifting arm 71 all the time. When the left end 71*c* of the lifting arm 71 is biased upwards, a right end of the lifting arm 71 is biased downwards, and the pickup roller 61 is biased downwards.

<Power Transmission to Lifting Plate>

Next, a power transmission to the lifting plate will be described below. As shown in FIGS. 2A, 2B, 3A and 3B, the transmitting gear mechanism portion G includes the driving force input gear unit 110, a first idle gear 11, a clutch gear unit 80, a pressing plate lifting mechanism 90 (91 to 94), and a switching gear unit 96.

The driving force input gear unit 110 is coupled with a motor which is not shown in the diagram, and rotates whenever the motor is driven. The driving force input gear unit 110 is engaged with an input gear section 81 of the clutch gear unit 80 via the first idle gear 111.

Figure 4A:
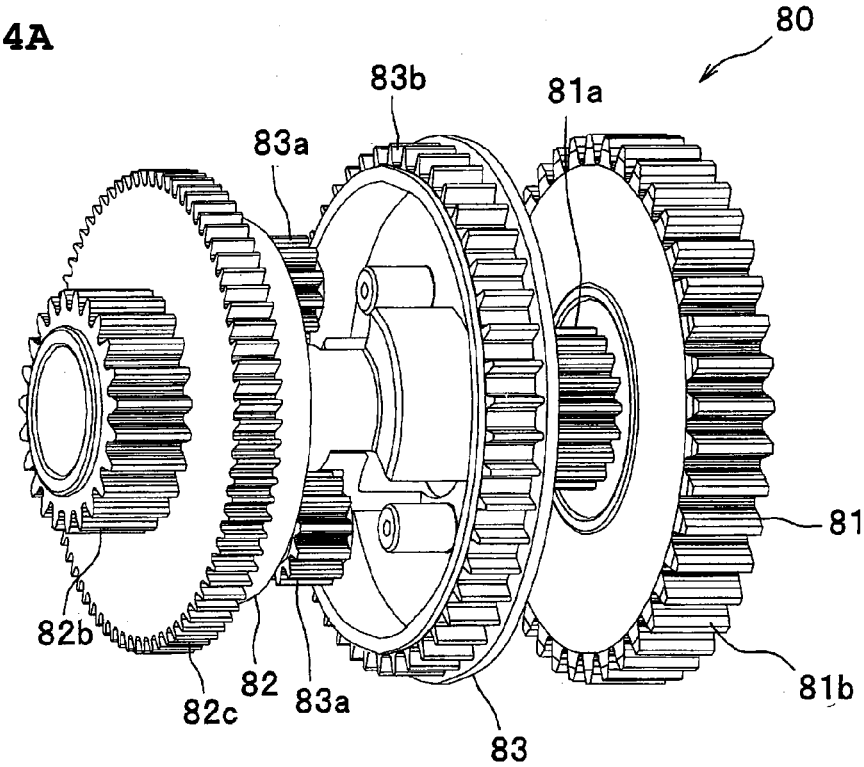
FIG. 4A and FIG. 4B are exploded perspective views of a clutch gear.
Figure 4B:
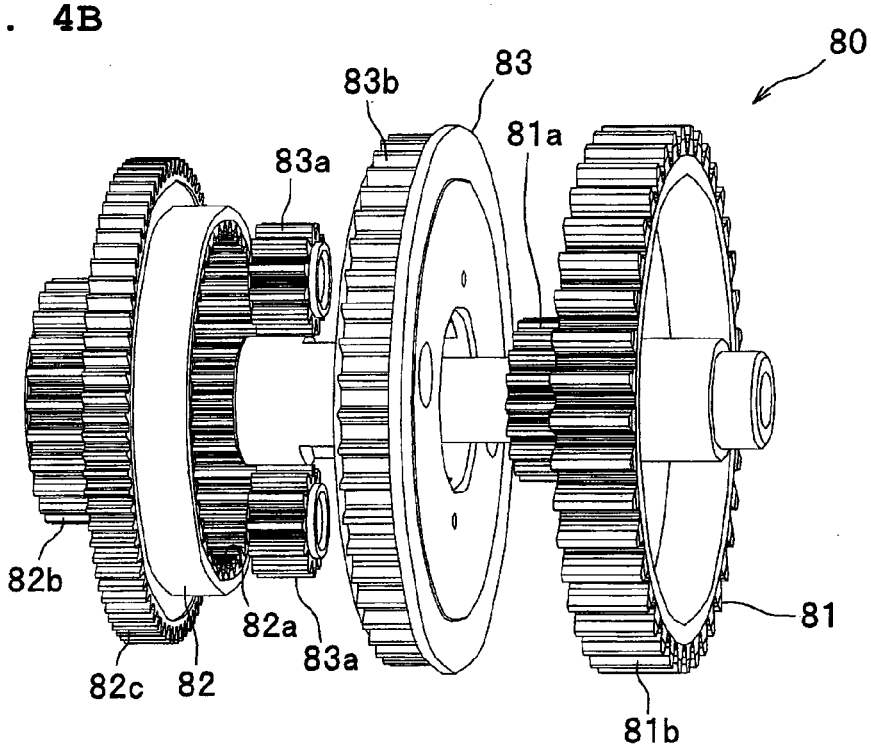

The clutch gear unit 80 is a gear set which controls whether or not the driving force from the input gear section 81 is to be transmitted to the pressing plate 51. As shown in FIGS. 4A and 4B, the clutch gear unit 80 includes a so-called planetary gear mechanism having the input gear section 81, an output gear section 82, and a triggering member 83.

The input gear section 81 has a so-called sun gear 81*a* of the planetary gear mechanism arranged at a central portion of the input gear section 81, and an outer gear 81*b* of which teeth are arranged at an outer circumference thereof and with which the first idle gear 111 is engaged.

The output gear section 82 includes a so-called ring gear 82*a* of the planetary gear mechanism arranged to face the triggering member 83, and an output gear 82*b* which is arranged not to face (opposite to) the triggering member 83. Moreover, the output gear section 82 has a stopper gear 82*c* of which teeth are arranged on an outer circumference thereof. The teeth of the stopper gear 82*c* are smaller in size and larger in number than those of the output gear 82*b*, and a diameter of the stopper gear 82*c* is larger than that of the output gear 82*b*. The stopper gear 82*c* does not function as a so-called gear, but it regulates a rotation of the output gear 82 when a stopper 130 which will be described later is engaged with the stopper gear 82*c*.

The triggering member 83 corresponds to a so-called carrier (planetary carrier) of the planetary gear mechanism, and includes two planetary gears 83*a* and a trigger gear 83*b* having teeth formed on an outer circumference thereof. The trigger gear 83*b* does not function as a gear. When a switching member 120 is engaged with trigger gear 83*b*, the driving power is transmitted from the input gear section 81 to the output gear 82. When the switching member 120 is disengaged with the trigger gear 83*b*, the transmission of the driving power from the input gear section 81 to the output gear 82 is cut off.

As shown in FIGS. 2A, 2B, and 3A, the pressing plate lifting mechanism 90 includes a first reduction gear section 91, a second idle gear 92, a second reduction gear section 93, and a lifting gear 94 (a tilting mechanism 91 to 94).

The first reduction gear section 91 includes a gear 91*a* of a large diameter which is engaged with the output gear 82*b* of the output gear section 82, and a gear 91*b* of a small diameter which is engaged with the second idle gear 92, thereby the rotation of the output gear 82*b* is transmitted to the second idle gear 92.

The second idle gear 92 is engaged with the gear 91*b* having a small diameter, of the first reduction gear section 91, and is also engaged with a gear 93*a* having a large diameter, of the second reduction gear section 93, thereby the rotation of the first reduction gear section 91 is transmitted to the second reduction gear section 93.

The second reduction gear section 93 includes the gear 93*a* which is engaged with the second idle gear 92, and a gear 93*b* having a small diameter which is engaged with the lifting gear 94, thereby the rotation of the second idle gear 92 is transmitted to the lifting gear 94.

As shown in FIG. 2B, the lifting gear 94 is formed to be sector-shaped, and the lifting plate 52 is fixed to a lower end of the lifting gear 94. A rotational axis of the lifting gear 94 coincides with a rear end of the lifting plate 52, and the rear end of the lifting plate 52 is a center of rotation of the lifting plate 52.

According to a structure of the abovementioned pressing plate lifting mechanism 90, the rotation of the output gear 82 is transmitted to the first reduction gear section 91, the second idle gear 92, the second reduction gear section 93, and the lifting gear 94 in this order, thereby rotating the lifting plate 52. When the lifting plate 52 is rotated, the lifting plate 52 lifts the pressing plate 51. Accordingly, the pressing plate 51 moves (rotates) upward.

<Structure for Switching Between Ascent and Stop of Pressing Plate>

Next, a pressing plate control mechanism which moves the pressing plate 51 up and down (vertically) and which stops an ascending movement of the pressing plate 51 when the pressing plate 51 has pushed the pickup roller 61 up to a paper feeding position via the paper 3 will be described below.

As shown in FIG. 3A, a first hook 73 and a second hook 74 are arranged at an upper portion and a lower portion of the left end 71*c* of the lifting arm 71, respectively. As shown in FIG. 3B, the first hook 73 has a front arm 73*a* and a rear arm 73*b*, and the second hook 74 has a front arm 74*a* and a rear arm 74*b*. The first hook 73 and the second hook 74 are swingably supported by the apparatus body with the same rotational axis. The front arms 73*a* and 74*a* of the first hook 73 and the second hook 74 respectively are pulled by a coil spring 75, and accordingly, when one of the first hook 73 and the second hook 74 is swung, the other hook is also pulled by the coil spring 75, and is swung.

Figure 5:
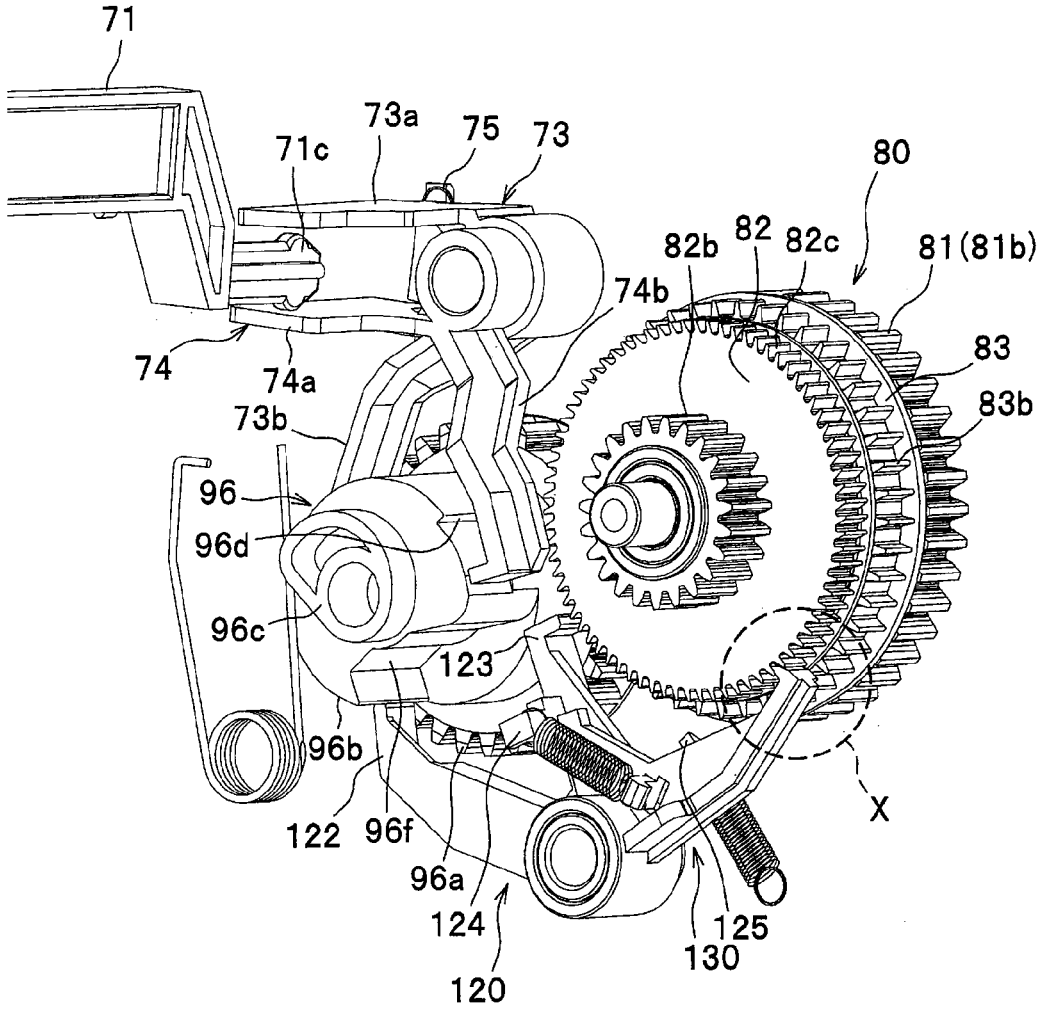
FIG. 5 is a perspective view of a pressing plate control mechanism.

Moreover, as shown in FIG. 5, front ends of the rear arms 73*b* and 74*b* of the first hook 73 and the second hook 74 respectively face a first cam portion 96*b* of the switching gear unit 96. According to a direction of the first hook 73 and the second hood 74, the front ends of the rear arms 73*b* and 74*b* engage with/disengage from a stepped portion 96*d* and a protrusion 96*e* of the first cam portion 96*b*.

The switching gear unit 96 includes an outer gear 96*a* which is located at the outermost circumference of the switching gear unit 96 and which has a toothed portion and a missing-teeth portion 96*j* in which no gear tooth is formed (refer to FIG. 8); a first cam portion 96*b* which is located at an inner side (right side) of the outer gear 96*a*; and a second cam portion 96*c* which is located at the inner side of the first cam portion 96*b*. The outer gear 96*a* can be engaged with outer gear 81*b* of the input gear section 81 of the clutch gear unit 80 which will be described later, and when the toothed portion of the outer gear 96*a* is engaged with the outer gear 81*b*, the rotation of the input gear section 81 is transmitted to the switching gear unit 96.

Figure 8:
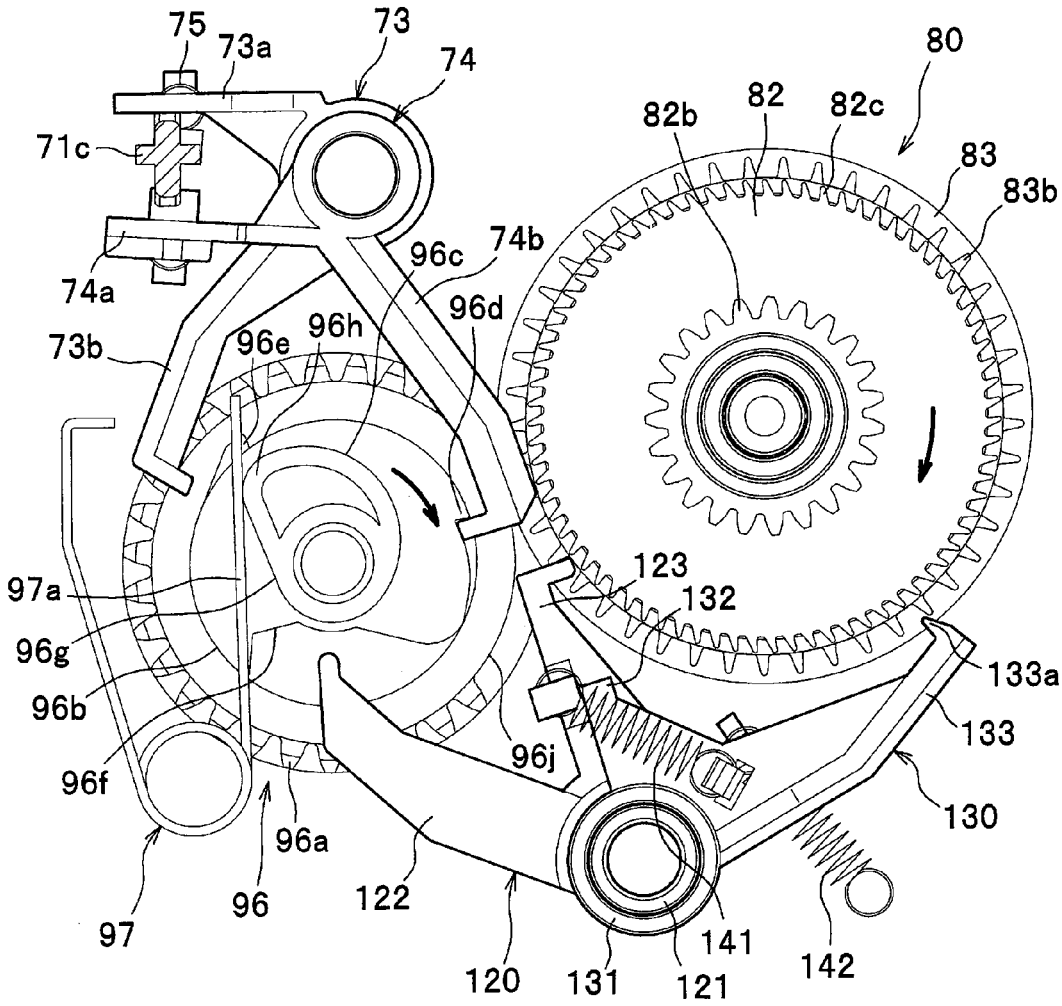
FIG. 8 is a diagram showing a state of the pressing plate control mechanism at the time of an ascent of the pressing plate.
Figure 9:
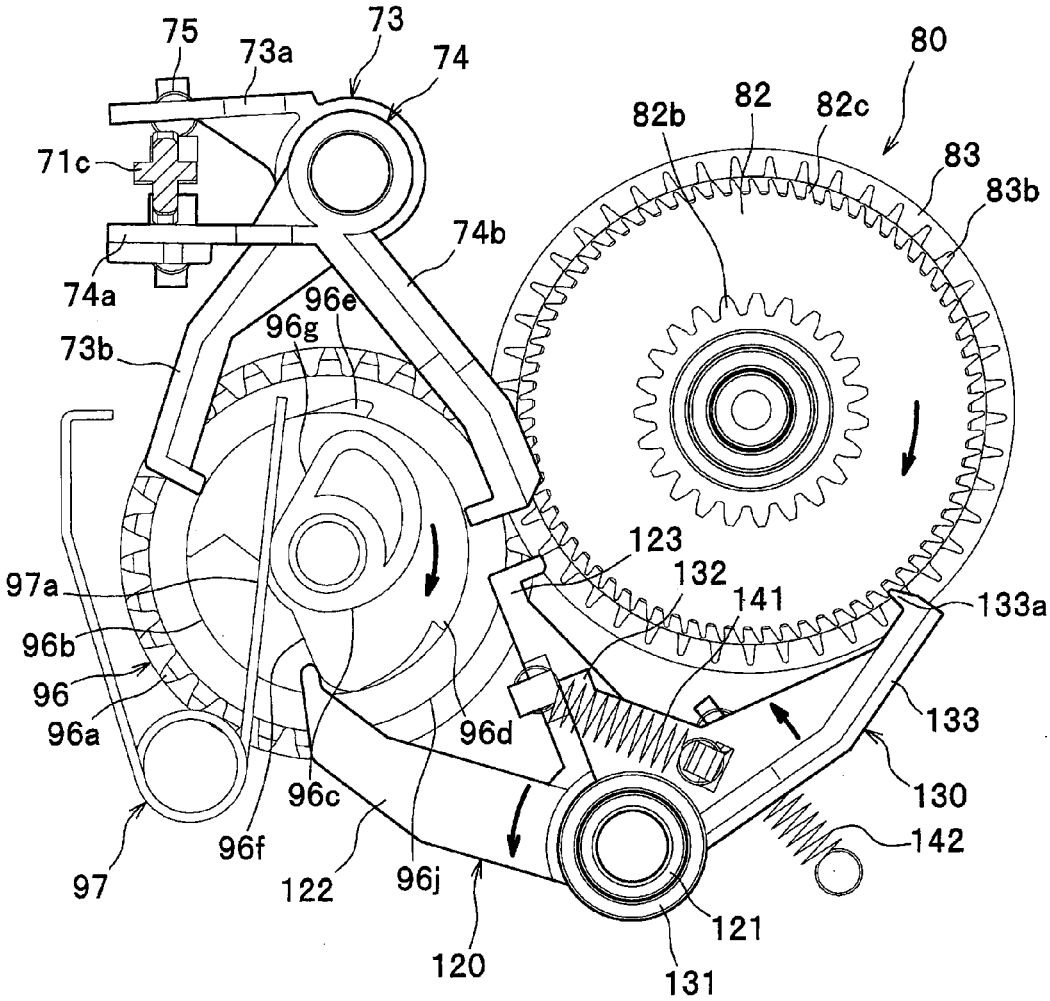
FIG. 9 is a diagram showing a state of the pressing plate control mechanism on half way when the pressing plate is switched from ascent to stop.
Figure 10:
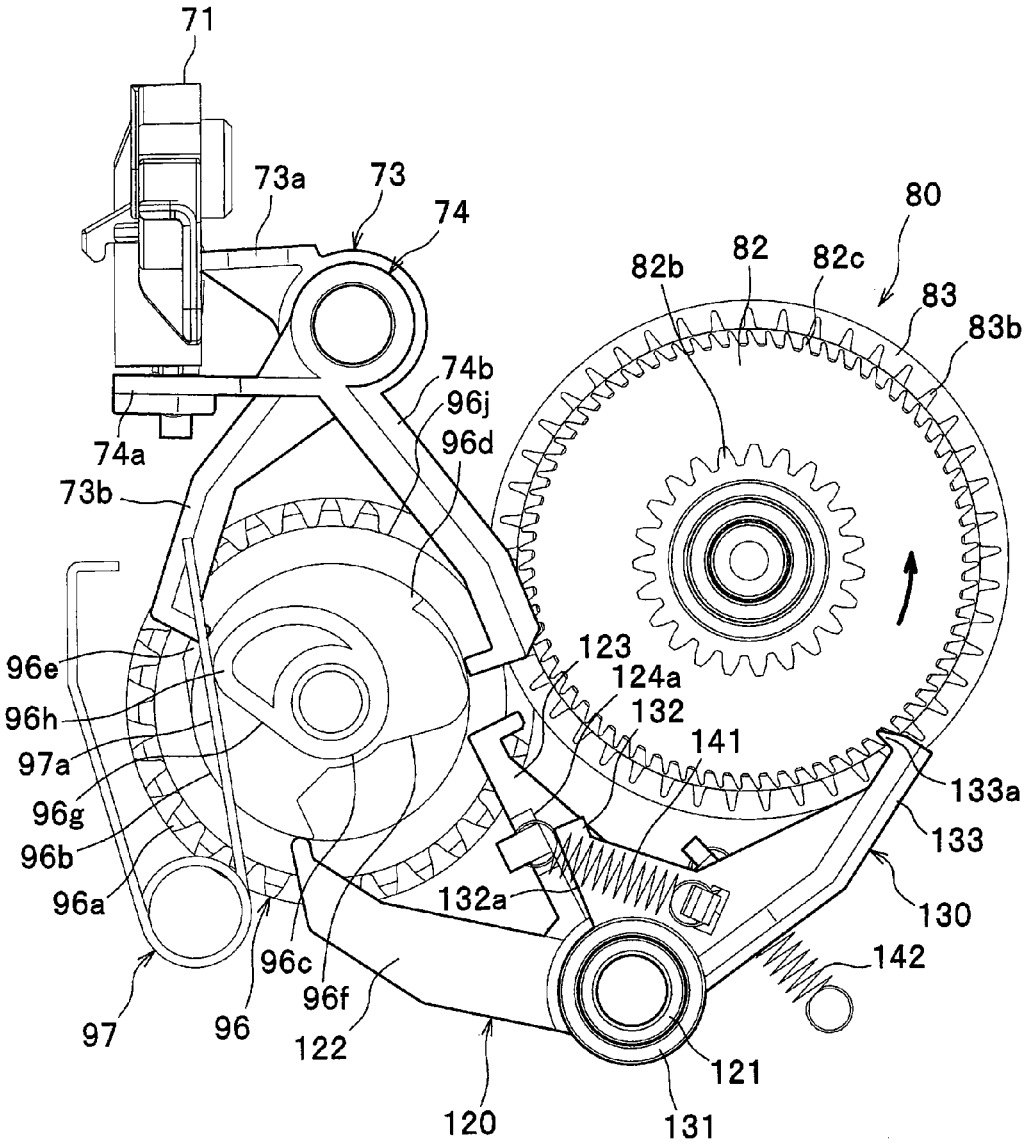
FIG. 10 is a diagram showing a state of the pressing plate control mechanism when the pressing plate has stopped after ascending.

The first cam portion 96*b* includes the protrusion 96*e*, the stepped portion 96*d*, and a recess 96*f* which are formed at an outer circumferential surface of the first cam portion 96*b* having a smooth circular cylindrical shape (refer to diagrams from FIGS. 8 to 10). As shown in FIG. 8, with respect to an axial direction of the switching gear unit 96, the stepped portion 96*d* is provided only in a range in which the rear arm 74*b* can reach. Therefore, the front end of the rear arm 74*b* of the second hook 74 can be engaged with the stepped portion 96*d* but the front end of the rear arm 73*b* of the first hook 73 cannot be engaged with the stepped portion 96*d*. Moreover, the protrusion 96*e* is provided only in a range in which the rear arm 73*b* can reach, with respect to the axial direction of the switching gear unit 96. Therefore, the rear arm 73*b* of the first hook 73 can be engaged with the protrusion 96*e* but the rear arm 74*b* of the second hook 74 cannot be engaged with the protrusion 96*e*. In other words, the positions of the stepped portion 96*d* and the protrusion 96*e* are shifted with each other in the axial direction of the switching gear unit 96, such that the stepped portion 96*d* can only engage with the rear arm 74*b* of the second hook 74 and that the protrusion 96*e* can only engage with the rear arm 73*b* of the first hook 73.

The second cam portion 96*c* has an oval profile as a whole, and also has a flat surface portion 96*g*. One arm 97*a* of a torsion spring 97 makes contact all the time with the second cam portion 96*c*. As shown in FIG. 8, when the arm 97*a* is in a contact with an oval shaped front end portion 96*b* of the second cam portion 96*c*, a force which rotates the switching gear unit 96 in a direction in which the arm 97*a* tends to make a contact with the flat surface portion 96*g* of the second cam portion 96*c* is generated. In other words, the rotating force in a clockwise direction in FIG. 8 is generated.

Figure 6:
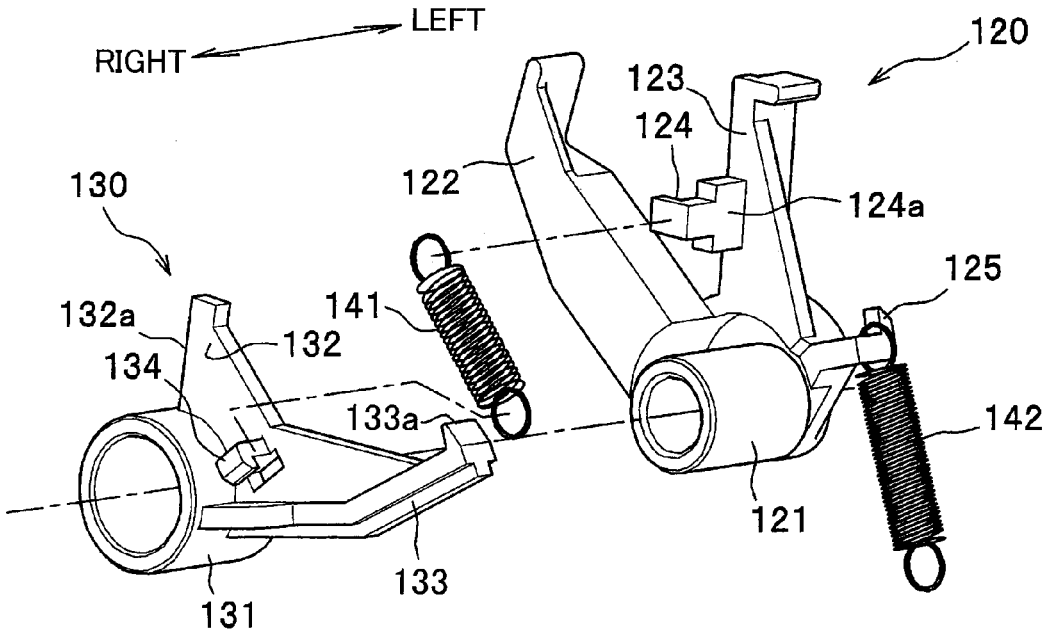
FIG. 6 is an exploded perspective view of a switching member and a stopper.

As shown in FIGS. 5 and 6, a switching member 120 is arranged at a lower side of the output gear section 82 of the clutch gear unit 80. The switching member 120 is swingably supported around a shaft portion 121, and has a front arm 122 and a rear arm 123. A front end of the front arm 122 faces a cam surface of the first cam portion 96*b* of the switching gear unit 96, and a front end of the rear arm 123 faces an outer circumference (periphery) of the triggering member 83, in other words, faces the trigger gear 83*b*. As shown in FIG. 6, a spring latching portion 124 which protrudes toward the stopper 130 is provided on a right-side surface of the rear arm 123. Moreover, a spring latching portion 125 is provided on a rear side of the shaft portion 121 to which the rear arm 123 is extended.

One end of a spring 141, as an example of a spring member, is engaged with the spring latching portion 124. The spring 141 draws the stopper 130 and the switching member 120 mutually. A surface on a rear side of the spring latching portion 124 is a contact surface 124*a* which receives a force of the spring 141 upon making a contact with the stopper 130. Here, an example of a coil spring is cited as the spring 141. However, the spring 141 is not restricted to the coil spring, and it is also possible to use a torsion spring. One end of a spring 142 is engaged with the spring latching portion 125, and is drawn by the spring 142 all the time. Accordingly, a bias is applied to the switching member 120 in a clockwise direction in FIGS. 5 and 6.

The stopper 130 which is swingable around a same shaft as the switching member 120 is provided on a right side of the switching member 120. The stopper 130 has a shaft portion 131, a front arm 132, a rear arm 133, and a spring latching portion 134. The shaft portion 131 is fitted at an outer side of the shaft portion 121 of the switching member 120, and supports the shaft such that the stopper 130 is swingable around the same shaft as the switching member 120. The front arm 132 is extended substantially upward from the shaft portion 131 in FIG. 6. A front surface 132*a* of the front arm 132 is arranged at a position such that it is possible to make a contact with the contact surface 124*a* of the switching member 120. The rear arm 133, as shown in FIGS. 5 and 6, is extended rearward from the shaft portion 131. A hook 133*a* as an engaging portion, is formed at a front end of the rear arm 133. A front end of the hook 133*a* faces the stopper gear teeth 82*c* of the output gear 82. The other end of the spring 141 is engaged with the spring latching portion 134, and is pulled by the spring 141 all the time. Accordingly, the stopper 30 is biased in a counterclockwise direction in FIGS. 5 and 6. When the contact surface 124*a* of the switching member 120 and the front surface 132*a* of the front-side arm 132 are in a contact, the switching member 120 and the stopper 130 are integrated, and are swung simultaneously due to the bias applied by the spring 141.

Figure 7:
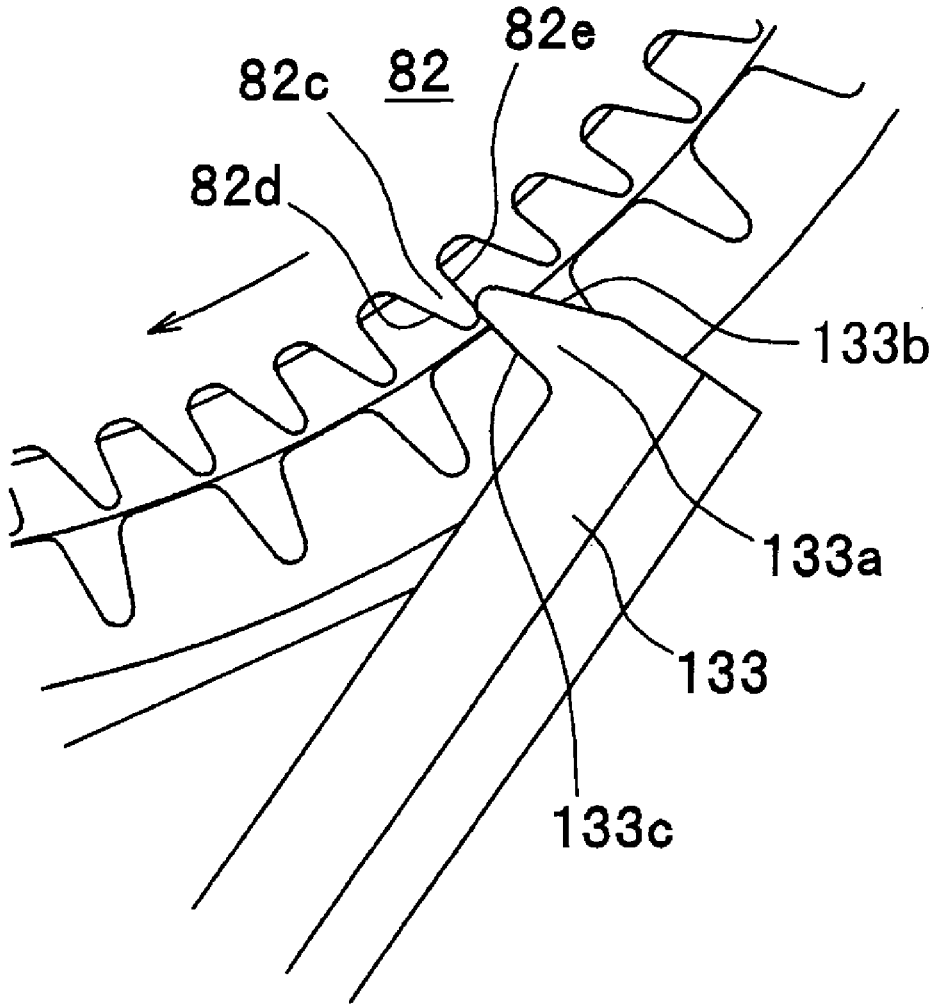
FIG. 7 is an enlarged view of an X-portion of FIG. 5.

As shown in FIG. 7, the stopper gear 82*c* of the output gear section 82 are formed as a ratchet gear. In other words, a front surface, of each of the teeth of the stopper gear 82*c*, in a direction of rotation is an inclined surface (a first inclined surface) 82*d* which is inclined such that the tip of each of the teeth is shifted toward the backward direction of the rotation. Here, the frontward direction of the rotation means a rotational direction of the stopper gear 82*c* (a clockwise direction in FIG. 7), when the driving force of the driving force input gear 110 is applied to the output gear section 82. Moreover, a rear surface, of each of the teeth of the stopper gear 82*c*, in the direction of the rotation is also an inclined surface 82*e* in which an inner diameter side thereof is shifted in the frontward direction of rotation, similarly to the inclined surface 82*d*. Whereas, the hook 133*a* which is located at the front end of the rear arm of the stopper 130 is formed as a so-called ratchet claw. In other words, a rear surface of the hook 133*a*, in the rearward direction of rotation of the output gear 82, which is located at the front end of the rear arm 133 of the stopper 130 is an inclined surface (second inclined surface) 133*b*. The inclined surface 133*b* is inclined such that the tip of the hook 133*a* is shifted toward the frontward direction of the rotation of the output gear 82. Moreover, a front surface of the hook 133*a* is an inclined surface 133*c* in which the tip side of the inclined surface 133*c* is inclined toward the frontward direction of rotation of the output gear 82.

Therefore, when the stopper gear 82*c* and the hook 133*a* tend to be engaged while the output gear 82 is rotated by the driving force of the driving force input gear 110, the inclined surface 82*d* and the inclined surface 133*b* make a sliding contact, and move the rear arm 133 to be drawn away from the output gear 82. In this case, no excessive load is exerted to the rear arm 133. Whereas, when the driving force of the driving force input gear 110 is not transmitted to the output gear 82, and when the output gear 82 tends to undergo reverse rotation (counterclockwise direction in FIG. 7) due to weight of the papers 3 and the pressing plate 51, the inclined surface 82*e* and the inclined surface 133*c* tend to be engaged if the stopper gear teeth 82*c* and the hook 133*a* are even somewhat snagged on. Therefore, the engagement of the stopper gear 82*c* and the hook 133*a* is maintained, and the pressing plate 51 is prevented from descending.

An operation of the laser printer 1 having the abovementioned structure will be described below by referring mainly to peculiarities of the present invention. When the pressing plate 51 is positioned at a lowermost portion as in a case when the paper feeding tray 11 is set to the apparatus body, a control section of the laser printer 1 makes rotate the driving force input gear unit 110. At this time, a position of an uppermost site of the paper 3 is not ascended up to a paper feeding position. Therefore, the pickup roller is swung downwards, and the right end of the lifting arm 71 is lowered downwards in FIGS. 3A and 3B, and the left end 71*c* of the lifting arm is raised upward.

Therefore, the left end 71*c* of the lifting arm 71 pushes up the front arm 73*a* of the first hook 73. Therefore, as shown in FIG. 8, since the second hook 74 also rotates (is turned) in a clockwise direction, the rear arm 74*b* and the stepped portion 96*d* are engaged, and accordingly, the switching gear unit 96 stops. At this time, since the outer gear 81*b* of the input gear section 81 faces the gear-missing portion 96*j* of the switching gear unit 96, the rotation of the input gear section 81 is not transmitted to the switching gear unit 96. At this time, since the front arm 122 of the switching member 120 faces the recess 96*f* of the switching gear unit 96, due to the bias force imparted by the spring 142, the switching member 120 and the stopper 130 rotate in a clockwise direction in FIG. 8, and the rear arm 123 of the switching member 120 is engaged with the trigger gear 83*b* of the triggering member 83.

When the rear arm 123 is engaged with the triggering member 83 of the clutch gear unit 80, and the rotation of the triggering member 83 is constrained, the driving force which is input to the input gear unit 81 is transmitted to the output gear unit 82. In other words, the driving force, which is input from the driving force input gear unit 110 to the input gear unit 81 of the clutch gear unit 80 via the first idle gear 111, is transmitted to the output gear unit 82 upon being reduced. The direction of rotation of the output gear unit 82 at this time is opposite to the direction of rotation of the input gear unit 81 as shown by an arrow in FIG. 3A. The rotation of the output gear unit 82 is transmitted to the first reduction gear 91, the second idle gear 92, the second reduction gear 93, and the lifting gear 94 in this order, and rotates (turns) the lifting plate 52. Due to the rotation of the lifting plate 52, the pressing plate 51 ascends.

When the pressing plate 51 ascends, the papers 3 ascend to lift the pickup roller 61 up. With the ascent of the pickup roller 61, the right end of the lifting arm 71 rises up and the left end 71*c* of the lifting arm 71 descends. Due to the descent of the left end 71*c* of the lifting arm 71, the left end 71*c* pushes down the front arm 74*a* of the second hook 74, and the first hook 73 and the second hook 74 are swung in a counterclockwise direction in FIG. 8. When the rear arm 74*b* of the second hook 74 is swung in the counterclockwise direction and comes off the stepping portion 96*d*, the switching gear unit 96 rotates in a clockwise direction in FIG. 8 by the arm 97*a* of the torsion spring 97 pressing a front-end portion 96*h* of the second cam portion 96*c*. Accordingly, the outer gear 96*a* of the switching gear unit 96 and the input gear unit 81 are engaged, and the rotation of the input gear unit 81 is transmitted to the switching gear unit 96. As shown in FIG. 9, when the switching gear unit 96 rotates in the clockwise direction, an inclined surface of the recess 96*f* pushes the front arm 122 of the switching member 120, and rotates the switching member 120 in a counterclockwise direction in FIG. 9. At this time, since the stopper 130 is pressed against the switching member 120 by the spring 141, the switching member 120 and the stopper 130 are integrated and rotate integrally.

Accordingly, a front end of the rear arm 123 of the switching member 120 is disengaged (separated) gradually from the trigger gear 83*b* of the triggering member 83, and also the hook 133*a* of the rear arm 133 of the stopper 130 is engaged gradually with the stopper gear 82*c*. In this embodiment, the engagement of the hook 133*a* with the stopper gear 82*c* is slightly before the disengagement (separation) from the trigger gear 83*b* of the front end of the rear arm 123. Moreover, as shown in FIG. 10, when the switching member 120 and the stopper 130 rotate in the counterclockwise direction in FIG. 9, the front end of the rear arm 123 of the switching member 120 is completely disengaged (separated) from the trigger gear 83*b*, and the hook 133*a* of the stopper 130 is completely engaged with the stopper gear 82*c*. At this time, since the spring 141 is deformed to be extended, the switching member 120 is swung independently of the stopper 130. Therefore, the front end of the rear arm 123 is capable of separating (disengaging) from the trigger gear 83*b* leaving a sufficient distance. Moreover, when the front end of the rear arm 73*b* of the first hook 73 is engaged with the protrusion 96*e* of the first cam portion 96*b* of the switching gear unit 96, the switching gear unit 96 stops, and the outer gear 81*b* of the input gear section 81 of the clutch gear unit 80 faces the missing-teeth portion 96*j* of the outer gear 96*a* of the switching gear unit 96. Therefore, the rotation of the input gear section 81 ceases to be transmitted to the switching gear unit 96.

When the front end of the rear arm 123 is disengaged (separated) from the trigger gear 83*b*, the rotation of the input gear section 81 ceases to be transmitted to the output gear 82, and the ascent of the pressing plate 51 stops. When the rotation of the input gear section 81 is ceased to be transmitted to the output gear section 82, the output gear section 82 tends to rotate in a reverse direction (counterclockwise direction in FIG. 10) due to the weight of the papers 3 and the pressing plate 51. However, at this time, since the hook 133*a* of the stopper 130 is already engaged with the stopper gear 82*c*, the output gear section 82 does not rotate. In other words, a force due to which the papers 3 and the pressing plate 51 tend to descend is received by the engagement of the hook 133*a* of the stopper 130 and the stopper gear 82*c*, and the papers 3 and the pressing plate 51 do not descend. The rotation of the driving force input gear unit 110 is stopped by the control section at an appropriate timing.

Moreover, after the pressing plate 51 has stopped, the pickup roller 61 goes on descending, with the consumption of the paper 3. Then, similarly as when the pressing plate 51 is positioned at the lowermost portion, once again the rotation of the input gear section 81 is transmitted to the output gear section 82, and the pressing plate 51 ascends.

In such manner, according to the laser printer 1 of the embodiment, it is possible to prevent the descent of the papers 3 and the pressing plate 51 without using a so-called one-way clutch. Moreover, in the pressing plate lifting mechanism and the pressing plate control mechanism of the embodiment, a bevel gear or a worm gear is not used, and spur gears are used for all the gears. Therefore, it is possible to have high efficiency of transmission of power, and to make a power of a drive source small, and to make the apparatus small size.

Moreover, the descent of the pressing plate 51 is stopped by stopping the rotation of the output gear section 82 by the stopper 130, and for the power transmission, the reduction gears (the first reduction gear 91 and the second reduction gear 93) are provided at a subsequent stage of the output gear 82. Therefore, an amount of descent of the pressing plate 51 due to a backlash (play) of the stopper gear 82*c* and the hook 133*a* is suppressed to be small by the reduction gears. As a result, the amount of descent of the pressing plate 51 becomes negligible (substantially small). Moreover, separately from the output gear 82*b* which draw power from the output gear section 82, the stopper gear 82*c* which are larger in diameter and has more teeth than the output gear 82*b* are provided, and the hook 133*a* is engaged with the stopper gear 82*c* but is not engaged with the output gear 82*b*. Therefore, the amount of descent of the pressing plate 51 due to the backlash of the stopper gear 82*c* and the hook 133*a* has become substantially small (negligible). According to an example of the embodiment shown in the diagrams, the amount of descent is about 0.2 mm maximum. Whereas, since it is possible to make a module of the output gear 82*b* large, it is possible to withstand a substantial transmission power.

Furthermore, when the stopper gear 82*c* and the hook 133*a* tend to be engaged in a state of the output gear section 82 rotating by the driving force of the driving force input gear unit 110, the inclined surface 82*d* and the inclined surface 133*b* are moved while making a sliding contact such that the rear arm 133 is separated from the output gear section 82. Therefore, no excessive load is exerted to the rear arm 133. Moreover, the inclined surface 82*e* and the inclined surface 133*c* tend to be engaged when the driving force of the driving force input gear unit 110 is ceased to be transmitted to the output gear section 82, after the stopper gear 82*c* and the hook 133*a* are engaged. Therefore, the engagement of the stopper gear 82*c* and the hook 133*a* is maintained, and the pressing plate 51 is prevented assuredly from descending.

The embodiment of the present invention has been described above. However, the present invention is not restricted to the embodiment described above, and it is possible to have various modifications appropriately. For example, in the embodiment, the sun gear of the planetary gear mechanism has been used as an input gear, the ring gear has been used as the output gear, and the carrier has been used as the triggering member. Accordingly, it is possible to reverse the direction of rotation of the input gear and the output gear, to achieve a substantial reduction gear ratio, and to reduce the number of gears. However, the present invention is not restricted to such combinations. For instance, as another example, it is also possible to use the sun gear as the input gear, to use the carrier as the output gear, to use the ring gear as the triggering member, and it is also possible to use with still another combination.

In the embodiment described above, the paper is used as a sheet material. However, it is also possible to use materials such as an OHP sheet, exactly in a similar manner.

Moreover, the pressing plate lifting mechanism and the pressing plate control mechanism described in the embodiment are mere examples, and these power transmitting mechanisms may be another structures.

In the embodiment described above, an example in which the stopper 130 is engaged with the output gear section 82 before the switching member 120 has disengaged from the triggering member 83 has been cited. However, the stopper 130 is engaged with the output gear section 82 at the same time as the switching member 120 is disengaged with the triggering member 83.

In the embodiment described above, a laser printer has been cited as an example of an image forming apparatus. However, the present invention is also applicable to a digital multi-function device and a copy machine.

What is claimed is:

1. An image forming apparatus which forms an image on sheet materials, comprising:

a body;

a tray which is detachably attached to the body, and configured to accommodate the sheet materials which are stacked;

a pickup roller which is arranged to be movable upward and downward, and which is configured to contact from an upper side an uppermost sheet material among the stacked sheet materials accommodated in the tray;

a pressing plate configured to be arranged below the sheet materials in the tray, and which is configured to lift the sheet materials up when the sheet materials are fed;

a planetary gear mechanism including a sun gear which has outer teeth formed on an outer circumferential surface thereof, a ring gear which has inner teeth formed on an inner circumferential surface thereof and which is arranged surrounding the sun gear, planetary gears which are arranged between the sun gear and the ring gear and which are engaged with both the sun gear and the ring gear, and a carrier which supports the planetary gears, one of the sun gear, the carrier, and the ring gear being an input gear section, and another one of the sun gear, the carrier, and the ring gear being an output gear section, and the remaining one of the sun gear, the carrier, and the ring gear being a triggering member for power transmission;

a drive source which is engaged with the input gear section and is configured to impart a driving power to the input gear section;

a pressing plate-lifting mechanism which is engaged with the output gear section and configured to convert rotation of the output gear section to a driving power for lifting the pressing plate upward;

a switching member which is swingably arranged in two directions of an ON side and an OFF side, and which is engaged with the triggering member when swung to the ON side to transmit the rotation of the input gear section to the output gear section, and which is disengaged from the triggering member when swung to the OFF side to cut off the rotation of the input gear section and the output gear section;

a pressing plate-control mechanism which is movable according to the upward and downward movement of the pickup roller, and which controls the switching member to swing to the OFF side when the pressing plate pushes the pickup roller upward to an uppermost position via the sheet materials, and which controls the switching member to swing to the ON side when the sheet materials are consumed and the pickup roller is lowered to a lowermost position;

a stopper which is swingable in synchronization with the switching member, and which is disengaged from the output gear section when the switching member is swung to the ON side to allow the rotation of the output gear section, and which is engaged with the output gear section when the switching member is swung to the OFF side to stop the rotation of the output gear section; and a spring member which biases the stopper toward the switching member to bring the stopper in contact with the switching member and to make the switching member and the stopper swing in synchronization, and which is deformed when the switching member is swung to the OFF side to make the switching member swingable separately from the stopper;

wherein when the switching member has swung to the OFF side, the stopper is engaged with the output gear section at a same time as the switching member is disengaged from the triggering member or before the switching member is disengaged from the triggering member.

2. The image forming apparatus according to claim 1, wherein the output gear section separately includes an output gear which is engaged with the pressing plate lifting mechanism, and a stopper gear which is engaged with the stopper, a number of teeth of the stopper gear being smaller than a number of teeth of the output gear.

3. The image forming apparatus according to claim 2, wherein each of the teeth of the stopper gear has a first inclined surface in which an outer side, in a radial direction of the stopper gear, of the first inclined surface is inclined toward a frontward direction of the rotation of the stopper gear, and an engaging portion of the stopper, which is engaged with the stopper gear, has a second inclined surface which is inclined such that the second inclined surface is substantially parallel to the first inclined surface when the engaging portion is engaged with the stopper gear, and when the driving force of the drive source is transmitted to the output gear to rotate the output gear in a state that the stopper and the output gear are engaged, the stopper is moved away from the output gear by sliding contact of the first inclined surface and the second inclined surface.

4. The image forming apparatus according to claim 1, wherein the ring gear is the output gear section, the carrier is the triggering member, and the sun gear is the input gear section.

5. The image forming apparatus according to claim 1, wherein the gears included in the planetary gear mechanism and the pressing plate lifting mechanism are all spur gears.

6. An image forming apparatus which forms an image on sheet materials, comprising:

a body;

a drive source configured to generate a driving force;

a tray which is detachably attached to the body, and configured to accomodate the sheet materials which are stacked;

a pressing plate lifting mechanism configured to be arranged under the sheet materials stacked in the tray, and which includes a pressing plate which is tilted to lift the sheet material upward, and a tilting mechanism which tilts the lifting plate;

a pickup roller mechanism which includes a pickup roller which is configured to be arranged under the sheet materials accommodated in the tray to be movable upward and downward, and a height-position adjusting mechanism configured to adjust a height position in an upward/downward direction of the pickup roller to bring the pickup roller in contact with an uppermost sheet material among the stacked sheet materials;

a power transmitting mechanism which is linked to the drive source and the tilting mechanism, and which is configured to transmit the driving force from the drive source to the tilting mechanism, the power transmitting mechanism including:

a first gear to which the driving force is input when the first gear is linked to the drive source;

a second gear which is linked to the tilting mechanism to transmit the driving force to the tilting mechanism; and a triggering member which is rotatably provided, wherein transmission of driving power from the first gear to the second gear is cut off when the triggering member is rotated, and the driving power is transmitted from the first gear to the second gear when the trigger member is not rotated;

a first stopper which is engaged with the second gear to stop the second gear;

a second stopper which is engaged with the triggering member to stop the triggering member; and an elongated member which is arranged swingably about a predetermined supporting point as a swinging center, and which is swung upward and downward with one end of the elongated member swinging upward and downward in synchronization with the pickup roller;

wherein when the elongated member is swung such that the one end of the elongated member is moved upward, the first stopper is engaged with the second gear to stop the second gear and the second stopper is disengaged from the triggering member to cut off the transmission of the driving power from the first gear to the second gear, and when the elongated member is swung such that the one end is moved downward, the first stopper is disengaged from the second gear to release the second gear and the second stopper is engaged with the triggering member to transmit the driving power of the drive source to the tilting mechanism via the first gear and the second gear to tilt the pressing plate upward.

7. The image forming apparatus according to claim 6, wherein the second gear is a ratchet gear and the first stopper is a ratchet claw.

8. The image forming apparatus according to claim 6, wherein the power transmitting mechanism includes a planetary gear mechanism including:

a sun gear which has outer tooth formed on an outer circumferential surface thereof;

a ring gear which has inner tooth formed on an inner circumferential surface thereof, and which is arranged surrounding the sun gear;

planetary gears which are arranged between the sun gear and the ring gear and which is engaged with both the sun gear and the ring gear; and a carrier which supports the planetary gears, wherein the first gear is the sun gear, the second gear is the ring gear, and the triggering member is a carrier.

9. The image forming apparatus according to claim 6, wherein the gears included in the power transmitting mechanism and the tilting mechanism are all spur gears.

* * * * *